United States Patent [19]

Leech, Jr.

[11] Patent Number: 4,896,598

[45] Date of Patent: Jan. 30, 1990

[54] PAD PRINTING PROCESS USING THIXOTROPIC INK

[75] Inventor: Charles S. Leech, Jr., Glendale, Ariz.

[73] Assignee: Automated Industrial Systems, Erie, Pa.

[21] Appl. No.: 316,480

[22] Filed: Feb. 27, 1989

[51] Int. Cl.[4] ..... B41F 17/00

[52] U.S. Cl. ..... 101/170; 101/491; 524/875; 260/DIG. 38

[58] Field of Search ..... 524/875; 260/DIG. 38; 101/163, 491, 41, 170

[56] References Cited

U.S. PATENT DOCUMENTS

| | | | |
|---|---|---|---|
| 2,322,445 | 6/1943 | Huber | 101/491 X |
| 3,607,822 | 9/1971 | Nishino | 524/875 X |
| 3,701,317 | 10/1972 | Miyamoto et al. | 101/163 X |
| 3,816,364 | 6/1974 | Bayer | 260/18 |
| 4,042,401 | 8/1977 | Newman et al. | 106/14.5 |
| 4,220,569 | 9/1980 | Borden et al. | 260/DIG. 38 |
| 4,304,706 | 12/1981 | Urs | 524/875 X |
| 4,334,471 | 6/1982 | Noyes et al. | 101/228 |
| 4,444,108 | 4/1984 | Jenness, III | 101/305 |
| 4,470,348 | 9/1984 | Seeley et al. | 101/219 |
| 4,480,008 | 10/1984 | Farronato et al. | 428/425.8 |
| 4,504,565 | 3/1985 | Baldvins et al. | 430/138 |
| 4,541,340 | 9/1985 | Peart et al. | 101/470 |

FOREIGN PATENT DOCUMENTS

| | | | |
|---|---|---|---|
| 56555 | 4/1985 | Japan | 101/163 |

*Primary Examiner*—Clifford D. Crowder

*Attorney, Agent, or Firm*—Dale R. Lovercheck; Charles L. Lovercheck; Wayne L. Lovercheck

[57] ABSTRACT

A process for printing an image on the surface of an article. The process provides a thixotropic thermal curable ink in a recess of a printing plate which is a facsimile of the image to be printed on the article. The ink is adapted to adhere to the printing plate upon contact therewith. The ink is adapted to conform to the facsimile of the image formed in the recess of said printing plate upon application stress to the ink.

11 Claims, 3 Drawing Sheets

* PRIOR ART

PAD PRINTING PROCESS USING THIXOTROPIC INK p REFERENCE TO PRIOR ART

Applicant is aware of the following prior art patents:
U.S. Pat. No. 3,816,364 to Bayer
U.S. Pat. No. 4,003,877 to Lipson et al.
U.S. Pat. No. 4,042,401 to Newman et al.
U S Pat. No. 4,271,757 to Maxwell et al.
U S. Pat. No. 4,334,471 to Noyes et al.
U S. Pat. No. 4,444,108 to Jenness, III
U.S. Pat. No. 4,470,348 to Seeley et al.
U.S. Pat. No. 4,480,008 to Farronato, et al.
U.S. Pat. No. 4,504,565 to Baldvins et al.
U.S. Pat. No. 4,518,634 to Gini et al.
U.S. Pat. No. 4,541,340 to Peart et al.
U.S. Pat. No. 4,555,532 to Tanaka et al.
U.S. Pat. No. 4,627,876 to Fries et al.
U.S. Pat. No. 4,711,802 to Tannenbaum et al.

BACKGROUND OF THE INVENTION

Pad printing of components has not been widely used in the electronics field because the ink processes and equipment were poorly suited to the electronics manufacturing field.

There are two traditional ink marking processes that are similar to one another, namely, the direct marking process and the dry offset. The direct marking process is a very slow process and is accomplished both by machinery and manually, where a raised image plate is coated with a thin film of ink which is applied directly to the device surface. In the direct marking process crude tools are sometimes used.

The dry offset marking process is used by almost one hundred percent of today's marking equipment. In this method, a raised image printing plate is coated with a film of ink. This film is transferred to a rubber surface (offset surface). The film is again transferred to the device to be marked.

GENERAL STATEMENT OF THE INVENTION

Applicant's pad printing process results in marks which ave from three to four times thicker ink films than offsetting marking. This increased film thickness results in brighter and better defined marking than is possible with offset processes. The inks used in applicant's process are more resistant to chemical and abrasion attack than any offset ink. Some users mark and cure devices and then send them through both plating and solder coating processes with no mark loss.

In applicant's process multiple devices can be printed simultaneously. Now lead frames can be deflashed, and then marked. The frames are usually in "trim and form" magazines, which allows automatic handling of devices. Earlier ink marking processes were extremely sensitive to the contact pressure between the ink film and the surface being marked. Due to the conformal characteristics of applicant's process, device surface height and planes are not problems. This capability allows marking in the assembly manufacturing operation. An added advantage of marking at assembly is that the age old problem of mixed device and mixed lots is virtually eliminated.

In applicant's process the mark cure and post mold cure process can be combined. In effect, this removes one process from the overall manufacturing process.

DETAILED DESCRIPTION OF THE DRAWINGS

Now with more particular reference to the drawings, FIGS. 1 through 8 are diagrams depicting the procedures involved in a traditional industrial pad printing process. FIGS. 9 through 15 depict the procedural steps in the processes according to the invention.

The traditional pad printing process illustrated in FIGS. 1 through 8 depend on the evaporation of solvents from the ink to operate. The evaporation of solvents from the surface of commercial pad printing inks form a sticky surface or tack layer which is vital to the process.

The amount of solvents in the traditional pad printing inks which are in the print head (working ink) determines the speed and quality of the resulting marking. Evaporation and subsequent addition of solvents to the working ink constantly changes the performance of the pad print process.

Applicant's process provides two important features of the invention (A) uses the thixotropic rheology of the ink to eliminate the required solvent evaporation and form an adhering tack layer and (B) the use of a blocked isocyanate to prevent premature polymerization of the ink in the print equipment and printed substrate. The thixotropic rheological mechanism of (A) is applicable to many resins and formulations other than that of a blocked isocyanate.

TABLE

COMPARING APPLICANT'S PROCESS WITH TRADITIONAL PAD PRINTING

| Steps | Traditional | Applicant |
|---|---|---|
| 1 | flood plate with ink | flood plate with ink |
| 2 | doctor off excess ink | doctor off excess ink The stress applied to the ink by the passage of the doctor blade over the print plate causes a momentary drop in viscosity which facilitates the filling of the intaglio image in the print plate. |
| 3 | wait for solvent to evaporate | substantially no time delay is required for return of viscosty due to the heavy thixotropic nature of the ink almost immediately after the passage of the doctor blade over the intaglio print plate. This allows the ink to return to its cohesive nature which provides the required adhesive properties to facilitate the transfer between the intaglio print plate to the elastomer print pad. |
| 4 | engage ink image with pad | engage ink image with pad |
| 5 | lift image with pad | lift image from plate with pad |
| 6 | wait for tack layer to form | substantially no time delay is required |
| 7 | engage work with pad | engage work with pad |
| 8 | lift pad from work | lift pad from work |

TRADITIONAL PAD PRINTING PROCESS

Step 1

Figure 1:
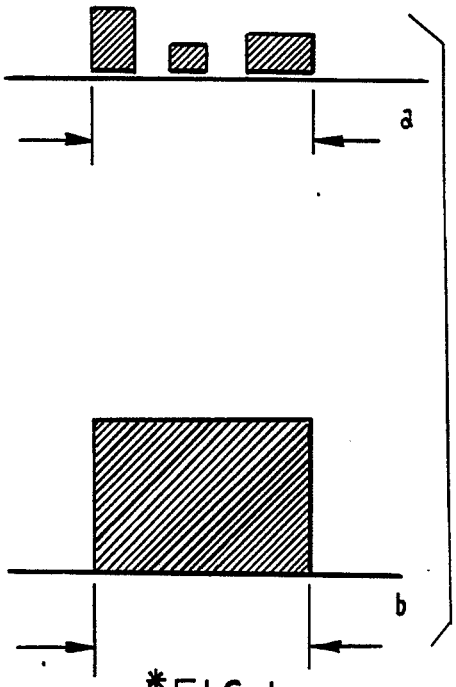
FIG. 1*a* schematically depicts the normal or broken and uneven film thickness which results from the "dry offset" marking process.
FIG. 1*b* indicates and example of a thicker and greater film thickness which may result from one form of the "Pad Printing" process. It is possible to produce almost any film thickness with the "Pad Printing" process while only relatively thin ink film thicknesses are produceable with the "dry offset" process.
Figure 2:
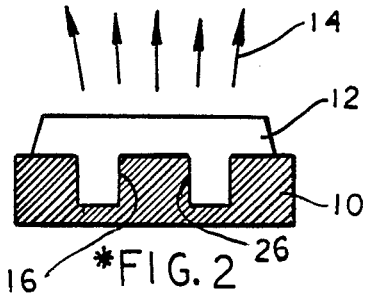
FIG. 2 depicts the flooded depressed, (intaglio) printing plate which as been flooded with ink. This is step 1 of the traditional printing process. The upward dispersed arrows represent the evaporation of solvents into the atmosphere.

As indicated in FIG. 2, the traditional process shows print plate 10 with depressed ink image 26 of the letter "0" etched into its surface. Print plate 10 is covered or flooded with a film of pad print ink 12. Ink 12 flows into etched recesses 16.

Step 2

Figure 3:
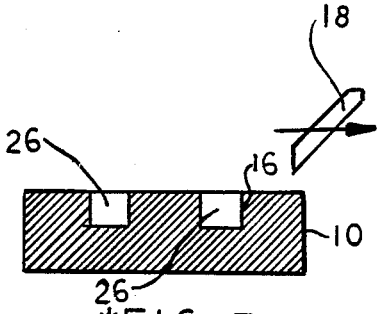
FIG. 3 depicts the second step in the traditional pad printing process showing that excess ink has been removed by the doctor blade.

In FIG. 3, excess print pad ink 12 is removed from the surface of print plate 10 by doctor blade 18. Blade 18 is shown to the right of FIG. 3.

Step 3

Figure 3A:
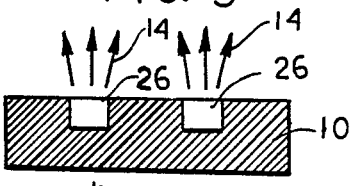
FIG. 3*a* depicts the third step in the traditional process where the solvent is evaporated and a critical tack layer is formed.

In FIG. 3A, solvents 14 in ink image 26 start to evaporate immediately, as indicated by the arrows. If left in this state for a period of time (as little as 15 minutes), ink image 26 will dry completely. When this happens, print plate 10 must be cleaned and the operation restarted. The traditional solution for this is to keep traditional equipment in motion as to continuously refresh the supply of solvent in the ink which is resident in etched recesses 16. Referring to FIG. *3a*, the surface portion of ink image 26 is exposed to air. The surface exposed to air forms a layer of "sticky ink" or tack layer 20. Tack layer 20 is critical in that it must be formed so that the pad print ink can be lifted out of recesses 16 in print plate 10.

Step 4

Figure 4:
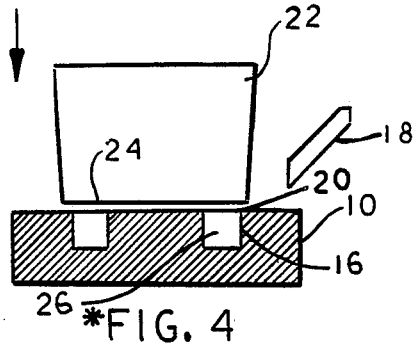
FIG. 4 depicts traditional step four which is the initial contact between the elastomer print pad and the tack layer formed by the traditional ink evaporation in step 3.

In FIG. 4, silicone rubber pad 22 is compressed onto the surface of print plate 10. If tack layer 20 is properly formed, ink image 26 will adhere to surface 24 of pad 22. The arrows denote the direction of pad travel.

Step 5

Figure 5:
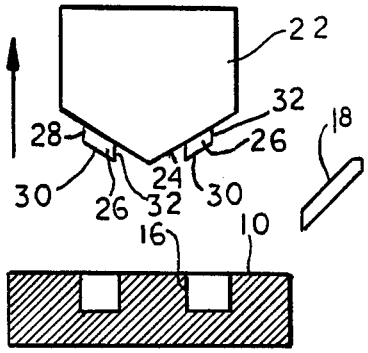
FIG. 5 illustrates the traditional fifth step which is the withdrawal of the elastomer print pad from the plate with about 80 percent of the ink adhered to the pad.

Now with reference to FIG. 5, print pad 22 is lifted from the surface of print plate 10. 80% of the ink image 26 from recesses 16 is transferred from print plate 10 to surface 24 of pad 22. Sides 28, 30, 32 of ink image 26, which were previously protected from the air, are now exposed. The arrows denote the direction of pad travel.

Step 6

Figure 6:
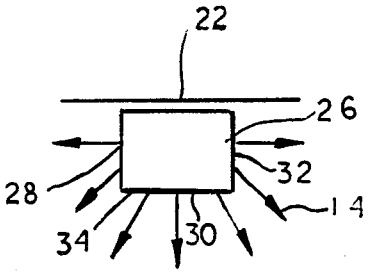
FIG. 6 PRIOR ART
FIG. 6 illustrates the traditional sixth step showing a schematic drawing of the secondary evaporation.

Now with reference to FIG. 6, during the period of time that ink image 26 is removed from print plate 10 and the point where ink image 26 is deposited on device 40, second tack layer 34 must be formed from solvents 14 which remained in ink image 26 from the formation of primary tack layer 20.

Obviously, if the majority of solvents evaporated in the formation of primary tack layer 20, very little will be available for formation of second tack layer 34. If remaining solvent is expended before ink image 26 is brought into contact with device 40, ink image 26 will be dried and will not be transferred. In this case the operation must be stopped and print pad 22 will have to be cleaned.

Step 7

Figure 7:
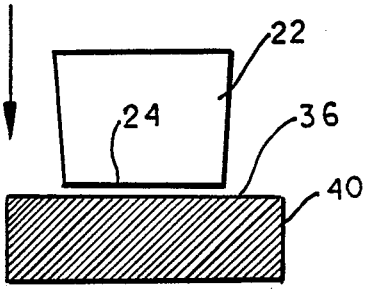
FIG. 7 illustrates the traditional seventh step depicting the contact between the print pad and ink image with the substrate to be printed.

Now with reference to FIG. 7, print pad 22 travels downward, carrying ink image 26 to surface 36 of device 40. While the drawing shows that print pad 22 is greatly compressed, the actual pressure is only as much as required to compress pad surface 24 which has ink image 26 thereon. Second tack layer 34 adheres to surface 36 of device 40. The adhesion between surface 36 of device 40 is greater than the adhesion between ink image 26 and print pad 22.

Step 8

Figure 8:
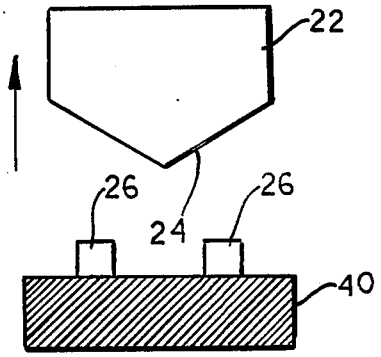
FIG. 8 illustrates the traditional eighth step depicting the transfer of the inked image to the device.

Now with reference to FIG. 8, print pad 22 has been lifted clear of the surface of ink image 26. 100 percent of ink image 26 has been removed from print pad 22. The area of print pad 22 where ink image 26 once was is now clean. In the case of devices which have severe particulate contamination (dust, mold, flash, and ceramic particles) the printing operation will continue without cleaning of print pad 22 which is important from a functional aspect.

The resulting ink mark is "dry to the touch" and can be carefully handled without danger of smearing in approximately 15 seconds after marking. "Dry to the touch" is not to say that the ink mark is cured or can resist solvents. Traditional inks will have a tendency to "ambient cure". While this cure will not withstand any marking permanency test, it will be sufficiently set to make removal for re-work difficult.

APPLICANT'S PROCESS

With reference to FIGS. 9–15, an example of such an ink contains the following ingredients. These are all blocked isocyanate formulations. Examples of epoxies, aliphatic, phenol and vinyl formulations could be furnished as well.

| Ingredients | Pounds |
|---|---|
| Example No. 1 | |
| Polyester Polyol | 296.05 |
| Organo Gel | 37.70 |
| Flow Enhancer | 6.97 |
| Pigment | 279.31 |
| Organic Extender | 33.51 |
| Aromatic Hydrocarbon Solvent | 27.07 |
| Fumed Silicate | 37.24 |
| Silicone Oil | 2.79 |
| MEKO Blocked Isocyanate | 371.00 |
| Tin Salts Catalyst | 21.44 |
| Example No. 2 | |
| Polyester Polyol | 296.05 |
| Organo Gel | 60.00 |
| Flow Enhancer | 6.97 |
| Pigment | 279.31 |
| Organic Extender | 33.51 |
| Fumed Silicate | 27.07 |
| Aromatic Hydrocarbon Solvent | 60.00 |
| Silicone Oil | 2.79 |
| MEKO Blocked Isocyanate | 371.00 |
| Tin Salts Catalyst | 37.94 |
| Example No. 3 | |
| Polyester Polyol | 296.05 |
| Organo Gel | 49.08 |
| Flow Enhancer | 6.97 |
| Pigment | 432.00 |
| Organic Extender | 43.51 |
| Fumed Silicate | 67.00 |
| Aromatic Hydrocarbon Solvent | 37.09 |
| Silicone Oil | 2.79 |
| MEKO Blocked Isocyanate | 371.00 |
| Tin Salts Catalyst | 37.94 |
| Example No. 4 | |
| Polyester Polyol | 296.05 |
| Organo Gel | 39.08 |
| Flow Enhancer | 6.97 |
| Pigment | 432.00 |
| Organic Extender | 35.51 |
| Fumed Silicate | 39.70 |
| Aromatic Hydrocarbon Solvent | 67.89 |
| Silicone Oil | 2.79 |
| MEKO Blocked Isocyanate | 371.00 |
| Tin Salts Catalyst | 21.44 |
| Example No. 5 | |
| Polyester Polyol | 296.05 |
| Organo Gel | 37.78 |
| Flow Enhancer | 6.97 |
| Pigment | 279.00 |
| Organic Extender | 35.51 |
| Fumed Silicate | 39.70 |
| Aromatic Hydrocarbon Solvent | 54.00 |
| Silicone Oil | 2.79 |
| MEKO Blocked Isocyanate | 371.00 |
| Tin Salts Catalyst | 21.44 |

APPLICANT'S PROCESS

Step 1

Figure 9:
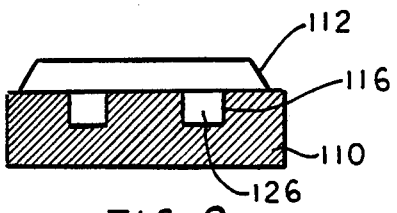
FIG. 9 depicts step one of applicant's improved pad printing process according to the invention which is flooding the print plate with ink.

Now with reference to FIG. 9, plate 110 is flooded with thixotropic blocked ink 112. There is very little solvent evaporation to an ink film of these ingredients. As a result, applicant's print plate 110 may be left flooded with ink for than one hour and still produce a good ink mark on the first stroke.

Step 2

Figure 10:
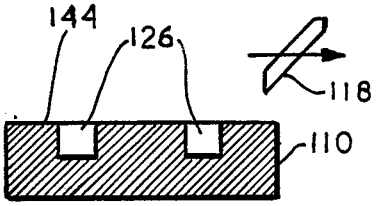
FIG. 10 illustrates step two of applicant's process which is the removal of the surplus ink from the surface of the intaglio print plate.

In FIG. 10, doctor blade 118 exposes inked image 126 in print plate 110. By passing doctor blade 118 over plate 110 the viscosity of thixotropic ink 112 is severely reduced and ink flow into etched recesses 116 in plate 110 is completed. Allowing ink 112 to return to its cohesive nature provides the required adhesion properties to facilitate the transfer of ink 112 from etched recesses 116 in plate 110 to the elastomer print pad 122. Unlike the traditional process, no solvent evaporation is required to form a tack layer. This is because of the rheological make up of applicant's inks. These inks form a cohesive film which is ready for transfer to print pad 122 immediately following the passage of doctor blade 118 over print plate surface 144.

Step 3

Figure 11:
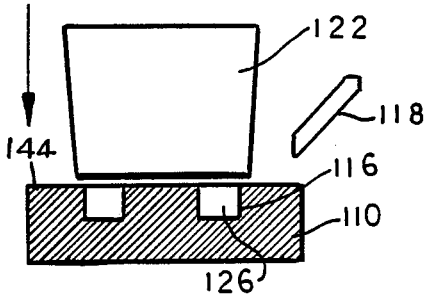
FIG. 11 is a diagram of step three of applicant's pad printing process.

Now with reference to FIG. 11, print pad 122 lowers to surface 144 of plate 110. Ink image 126 immediately adheres to print pad 122. This is due to the cohesive characteristics of the ink. In applicant's process the return to a heavy thixotropic nature of the ink returns almost immediately after the passage of doctor blade 118 over print plate 110. This allows ink 112 on image 126 to return to its cohesive nature which provides the required adhesive properties to facilitate the transfer between print plate 110 to elastomer print pad 122.

Step 4

Figure 12:
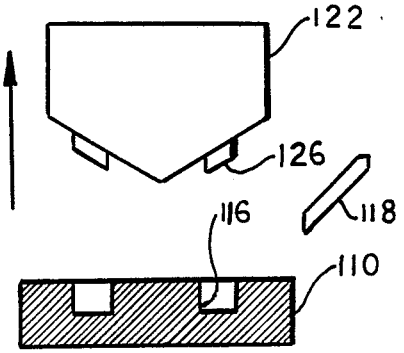
FIG. 12 illustrates step four of applicant's process which is the lifting of approximately 80% of the ink from the intaglio print plate by the elastomer print pad.

With reference to FIG. 12, print pad 122 rises, lifting approximately 80 percent of inked image 126 from print plate 110.

Step 5

Figure 13:
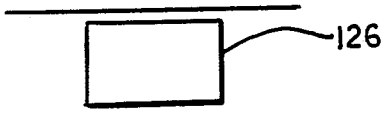
FIG. 13 depicts step five of applicant's process wherein the suspended image which is in the cohesive state with no solvent evaporation required to form a secondary tack layer.

With reference to FIG. 13, no waiting time is necessary for a second tack layer to be formed to allow transfer from print pad 122 to the surface of image 126. The time window for transfer to the surface of image 126 to be marked is very wide. Again this is due to the cohesive nature of inks.

Step 6

Figure 14:
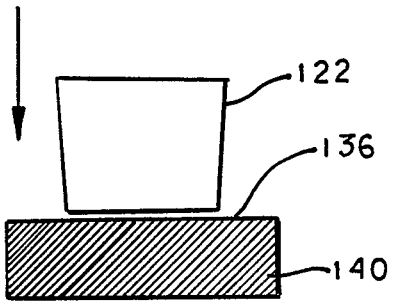
FIG. 14 depicts step six of applicant's process which is the compression of the elastomer pad onto the substrate to be printed.

With reference to FIG. 14, cohesive inked image 126 is transferred to surface 136 of device 140.

Step 7

Figure 15:
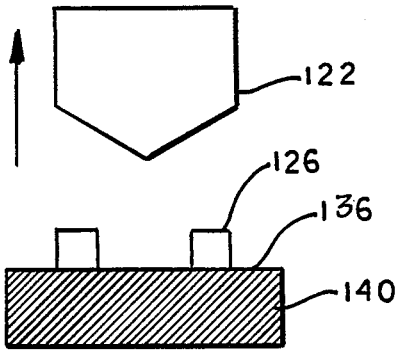
FIG. 15 depicts step seven showing the elevation of the elastomer print pad with the inked image remaining adhered to the surface of the substrate.

With reference to FIG. 15, print pad 122 has been lifted clear of device surface 136. 100 percent of inked image 126 has been removed from print pad 122. The area of print pad 122 where inked image 126 once was is now clean.

The resulting ink mark is "dry to the touch" and can be handled without danger of smearing in approximately 15 seconds after marking. "Dry to the touch" is not to say that the ink mark is cured or can resist solvents.

Applicant's inks do not ambient cure. Before thermal curing, these inks can be completely removed with no residue with only rubbing alcohol. By eliminating time spent for evaporation of solvents, applicant's ink avoids lost time, save time lost in cleaning printing pads and plate and other problems associated with traditional processes and inks. Applicant's process eliminates the critical time and speed relationship which exists due to the evaporation of solvents and the formation of the "tack" layer. The solution of the problem is an important feature of this invention.

The foregoing specification sets for the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A process for printing an image on the surface of an article comprising:

a. providing a printing plate having a recess that is a facsimile of a desired image and a thixotropic ink, said ink comprising a pigment and a catalyst, b. filling said recess with said ink including an excess of said ink, c. doctoring said excess ink from said plate by passing a doctoring blade over said plate to remove said excess ink from said plate whereby the viscosity of said thixotropic ink in said recess is severely reduced by the mechanical stress of the passage of said doctor blade over said image in said plate and ink flow into said recess in said plate is completed.

d. allowing said image to return to its cohesive nature which provides the required adhesive properties to facilitate the transfer of said image from said recess in said plate to an elastomer print pad, e. engaging said ink in said recess with said pad and lifting said pad whereby a substantial part of said image is lifted from said plate, f. substantially immediately transferring said image from said pad to said article, g. lifting said pad from said article thereby leaving said ink that was lifted from said recess on said article, thereby providing said image on said article.

2. A process for printing an image on the surface of an article comprising:

a. providing a printing plate having a recess that is a facsimile of a desired image and a thixotropic ink, said ink comprising a pigment and a catalyst b. filling said recess with said ink including an excess of said ink, c. mechanically removing said excess of said ink from said plate whereby the viscosity of said thixotropic ink in said recess is severely reduced by mechanism stress of said removal, d. substantially immediately engaging said image with a printing pad whereby said image adheres to said pad, e. lifting said pad whereby a substantial part of said image is lifted from said plate, f. transferring said ink lifted from said plate to said article, g. lifting said pad from said article thereby leaving said ink that was lifted from said plate on said article, thereby providing said image on said article.

3. The process recited in claim 1 wherein said recess is formed by etching.

4. The process recited in claim 1 wherein said ink is a blocked resin system.

5. The process recited in claim 1 wherein said ink is a thixotropic blocked isocyanate ink.

6. The process recited in claim 1 wherein said ink contains a major portion of polyester Polyol, pigment and MEKO blocked isocyanate.

7. A process for printing an image on the surface of an article, comprising:

providing a thixotropic thermal curable ink including an excess of said ink in a recess of a printing plate, removing said excess ink from said ink said recess whereby the viscosity of said thixotropic thermal curable ink in said recess is severly reduced.

said recess being a facsimile of said image, engaging said ink in said recess with a printing pad and transferring said ink in said recess to a printing plate whereby said ink will adhere to said printing plate upon contact of said printing plate and said ink, said ink being adapted to conform to said facsimile of said image of said recess of said printing plate upon application of stress by said removing of said ink.

8. The process of claim 7 wherein said ink is readily removable upon application thereto of rubbing alcohol before thermal curing.

9. The process of claim 7 wherein said ink comprises an a catalyst.

10. The process of claim 7 wherein said ink comprises pigment and catalyst.

11. The process of claim 7 wherein said ink comprises silicone oil, pigment and catalyst.

* * * * *